US008025183B2

(12) United States Patent
Szekely et al.

(10) Patent No.: US 8,025,183 B2
(45) Date of Patent: Sep. 27, 2011

(54) POUR SPOUT

(75) Inventors: Alex S. Szekely, Jackson, NJ (US); Peter A. Piscopo, Medford, NJ (US)

(73) Assignee: Plastek Industries, Inc., Erie, PA (US)

( * ) Notice: Subject to any disclaimer, the term of this patent is extended or adjusted under 35 U.S.C. 154(b) by 845 days.

(21) Appl. No.: 11/994,449

(22) PCT Filed: Jun. 14, 2007

(86) PCT No.: PCT/US2007/071195

§ 371 (c)(1),
(2), (4) Date: Jan. 2, 2008

(87) PCT Pub. No.: WO2007/147044

PCT Pub. Date: Dec. 21, 2007

(65) Prior Publication Data

US 2008/0164282 A1 Jul. 10, 2008

Related U.S. Application Data

(60) Provisional application No. 60/804,868, filed on Jun. 15, 2006.

(51) Int. Cl.
*B67D 1/16* (2006.01)

(52) U.S. Cl. ..... 222/111; 222/109; 222/562; 222/566; 220/288

(58) Field of Classification Search ..... 222/109, 222/111, 562, 566, 568, 570; 220/288
See application file for complete search history.

(56) References Cited

U.S. PATENT DOCUMENTS

| | | | | |
|---|---|---|---|---|
| 2,601,039 | A | 6/1952 | Livingstone | |
| 4,550,862 | A | 11/1985 | Barker et al. | |
| 4,696,416 | A * | 9/1987 | Muckenfuhs et al. | 222/109 |
| 4,706,829 | A * | 11/1987 | Li | 215/354 |
| 4,749,103 | A | 6/1988 | Barriac | |
| 4,830,234 | A * | 5/1989 | Odet | 222/465.1 |
| 4,844,302 | A * | 7/1989 | Lay | 222/568 |
| 4,917,268 | A | 4/1990 | Campbell et al. | |
| 4,917,270 | A * | 4/1990 | Simon | 222/111 |
| 5,060,827 | A * | 10/1991 | Segati | 222/109 |
| 5,108,009 | A * | 4/1992 | Davidson et al. | 222/109 |
| 5,251,788 | A * | 10/1993 | Moore | 222/111 |
| 5,566,862 | A | 10/1996 | Haffner et al. | |
| 5,603,787 | A | 2/1997 | Reid | |
| 5,794,803 | A * | 8/1998 | Sprick | 215/217 |
| 5,941,422 | A | 8/1999 | Struble | |
| 6,032,829 | A * | 3/2000 | Geisinger et al. | 222/111 |
| 6,223,946 | B1 * | 5/2001 | Geisinger et al. | 222/111 |
| 6,398,076 | B1 * | 6/2002 | Giblin et al. | 222/109 |
| 6,464,106 | B1 * | 10/2002 | Giblin et al. | 222/109 |
| 6,848,484 | B1 * | 2/2005 | Darr | 141/381 |
| 6,923,341 | B2 | 8/2005 | Smith | |
| 6,964,359 | B1 | 11/2005 | Darr et al. | |

(Continued)

*Primary Examiner* — Kevin P Shaver
*Assistant Examiner* — Donnell Long
(74) *Attorney, Agent, or Firm* — Bachman & LaPointe, P.C.

(57) ABSTRACT

A container (20) has a body (22) having a body opening (40). A spout fitment (24) is mounted within the body opening. A cap (26) has: a sidewall (120); a web (122) enclosing an upper end of the sidewall; a flange (124) extending outward from the sidewall; an external thread (132) along the sidewall below the flange; a removed condition disengaged from the body and spout fitment; and an installed condition threadingly mounted by the external thread to at least one of the body and spout fitment. In the installed condition, a perimeter portion (128) of the flange is below a rim (110) of the spout fitment.

14 Claims, 8 Drawing Sheets

U.S. PATENT DOCUMENTS 6,968,980 B2 * 11/2005 Giblin et al. ..... 222/109
7,036,693 B2 * 5/2006 Walsh et al. ..... 222/572
7,097,076 B1 * 8/2006 Giblin et al. ..... 222/109
7,677,423 B2 * 3/2010 Kasting et al. ..... 222/567
7,686,188 B2 * 3/2010 Stebick et al. ..... 222/109
7,703,641 B2 * 4/2010 Bravo et al. ..... 222/465.1
2006/0175349 A1 * 8/2006 Drosos et al. ..... 222/109
2006/0289570 A1 * 12/2006 Rohr et al. ..... 222/570
2007/0194047 A1 8/2007 Tauber et al.
2008/0277418 A1 * 11/2008 Vockler et al. ..... 222/111
2009/0101682 A1 4/2009 Szekely et al.
2010/0043910 A1 2/2010 Szekely et al.

* cited by examiner

POUR SPOUT

CROSS-REFERENCE TO RELATED APPLICATIONS

Benefit is claimed of U.S. Patent Application Ser. No. 60/804,868, filed Jun. 15, 2006, and entitled "Pour Spout", the disclosure of which is incorporated by reference herein as if set forth at length.

BACKGROUND OF THE INVENTION

The invention relates to containers. More particularly, the invention relates to pour spouts for containers for liquid laundry detergent and the like.

There has been an evolution in the configuration of containers for liquid laundry detergent, fabric softener, and the like. The dominant form of container is a wide mouth bottle having an attached spout with a drain-back trough and aperture. In a typical group of container configurations and their methods of assembly, a bottle, spout fitment, and cap are individually molded (e.g., of high density polyethylene (HDPE)). Exemplary bottle molding is via roto-molding whereas exemplary spout fitment and cap molding are by injection molding. An exemplary spout fitment includes the spout and a continuation of the spout defining the base and outboard wall of the trough. The fitment further typically includes a flange (e.g., extending outward at an upper end of the outboard extremity of the trough).

The spout fitment may be inserted through a mouth of the bottle (e.g., so that an outer surface of the outboard trough wall whereof another wall outboard thereof engages the inner surface of the bottle neck). The spout fitment may be secured and sealed to the bottle such as by spin welding. The bottle may be filled and the cap may be installed. Exemplary caps typically have either an externally threaded skirt for engaging an internally threaded portion of the fitment or an internally threaded skirt for engaging an externally threaded portion of the fitment or bottle neck. With a typical externally threaded skirt, the cap includes an outwardly projecting flange above the skirt. Upon installation of the cap to the fitment, the flange underside contacts and seals with the fitment flange upper surface to seal the bottle.

Various examples of bottles are shown in U.S. Pat. Nos. 6,923,341, 5,941,422, 5,566,862, and 5,603,787.

SUMMARY OF THE INVENTION

A container has a body having a body opening. A spout fitment is mounted within the body opening. A cap has: a sidewall; a web enclosing an upper end of the sidewall; a flange extending outward from the sidewall; an external thread along the sidewall below the flange; a removed condition disengaged from the body and spout fitment; and an installed condition threadingly mounted by the external thread to at least one of the body and spout fitment. In the installed condition, a perimeter portion of the flange is below a rim of the spout fitment.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
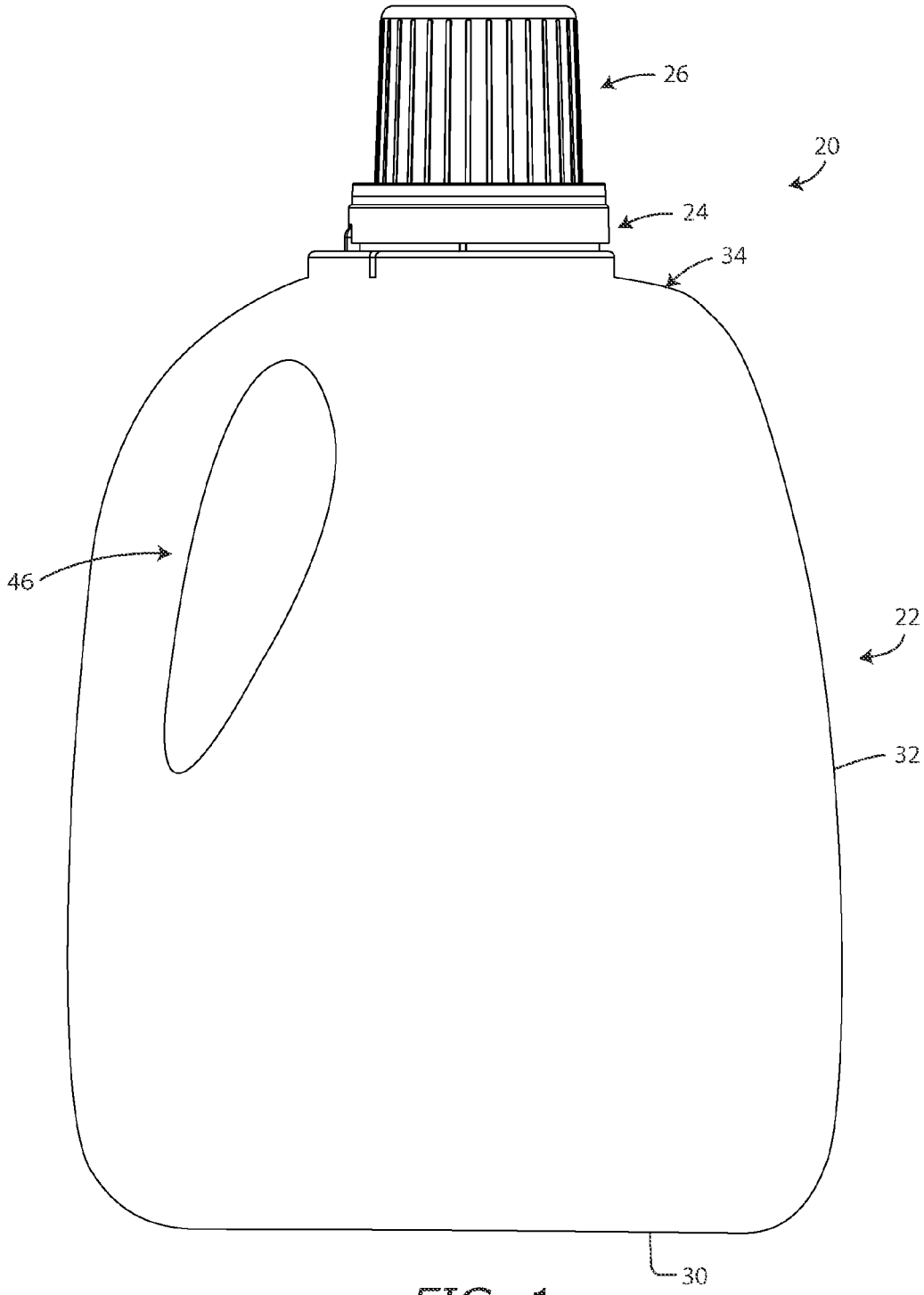
FIG. 1 is a view of a bottle.

FIG. 1 shows a container 20 comprising the assembly of a bottle body 22, a spout fitment 24, and a cap 26 (which may serve as a measuring/dispensing cup). Each may be made as a unitary plastic molding. Exemplary bottle body material is high density polyethylene (HDPE). Exemplary spout fitment and cap material is polypropylene.

Figure 2:
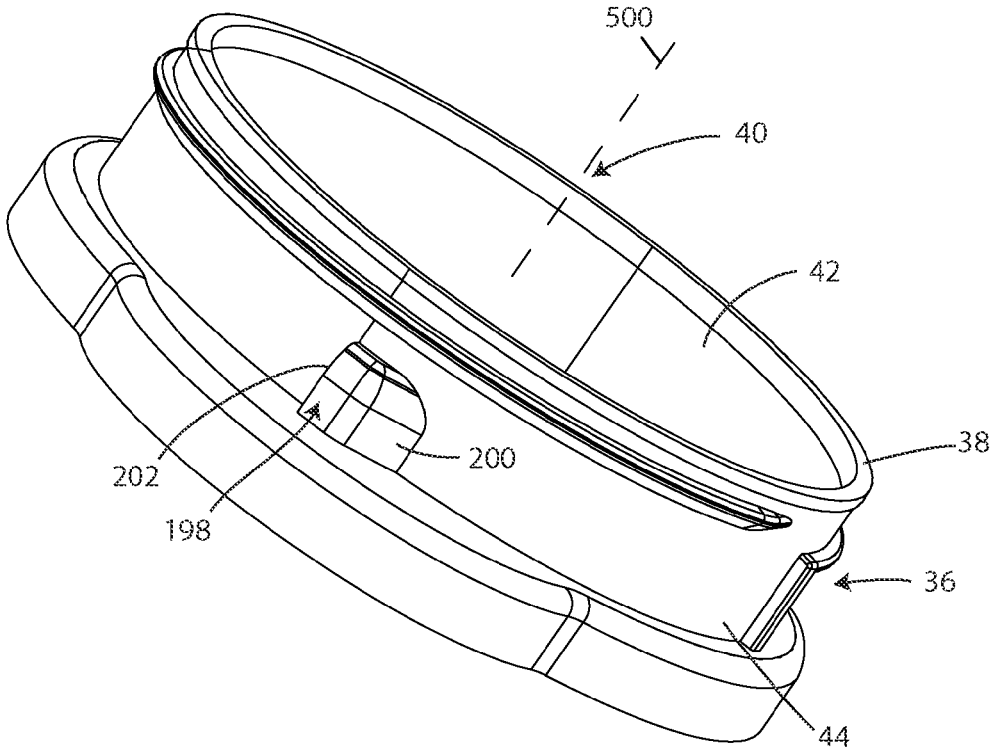
FIG. 2 is a view of a neck region of the bottle of FIG. 1.
Figure 5:
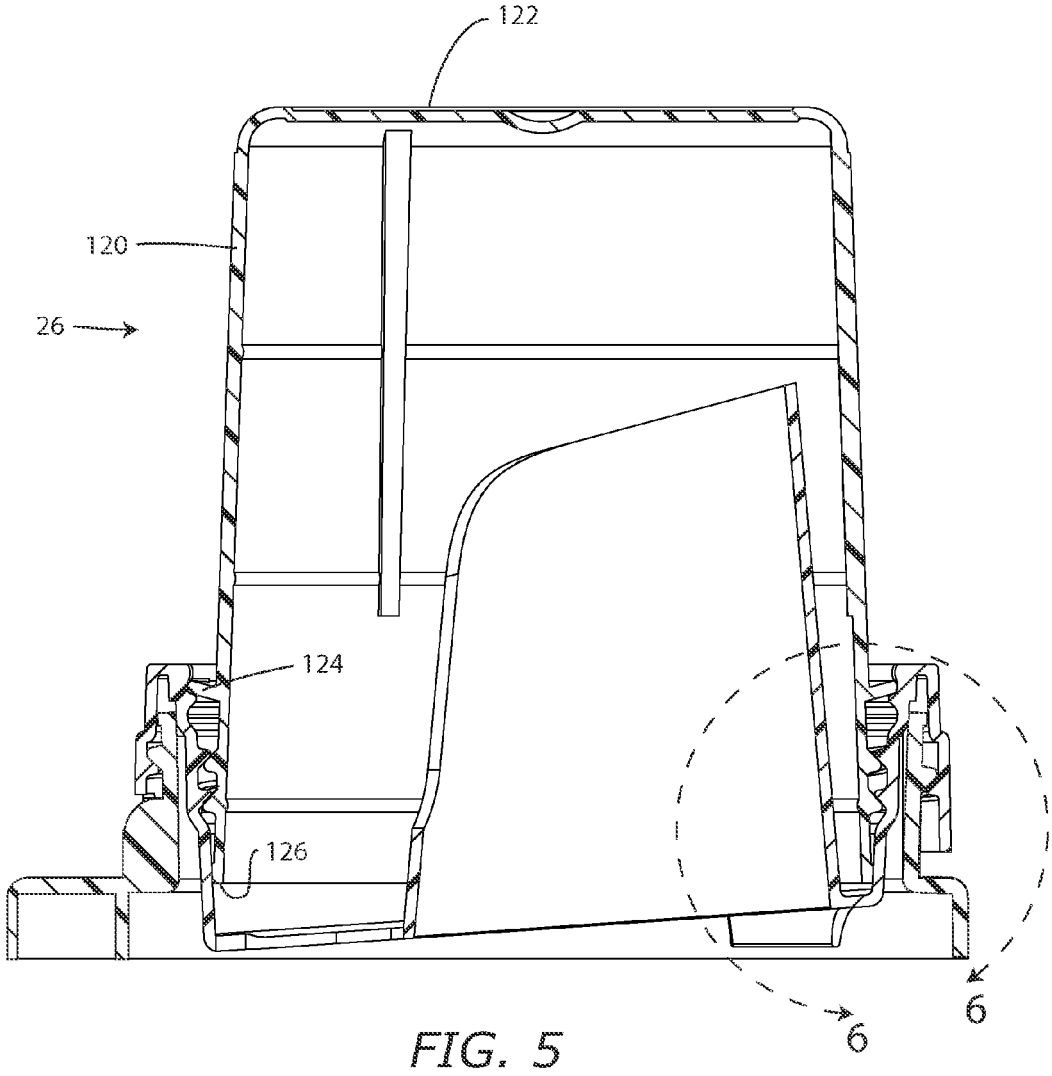
FIG. 5 is a vertical sectional view of the neck region, spout fitment, and cap of the bottle of FIG. 1.

The body 22 comprises a unitary combination of a base 30, a sidewall 32 extending upward from the base, a shoulder 34 at an upper end of the sidewall, and a neck 36 (FIGS. 2 and 3) extending upward from the shoulder to a rim 38 and defining an opening 40 having a central longitudinal axis 500. The bottle body has an interior surface 42 and an exterior surface 44. A handle 46 (FIG. 1) may extend from the sidewall and the body interior may extend through the handle The spout fitment 24 (FIG. 5) includes an inner wall 50 and an inner sidewall 52 joined by a lower wall 54 so as to define a trough 56. One or more drain-back apertures 58 are open to the trough (e.g., through the wall 54). The wall 50 has an upper end 60 defining a spout opening 62. The upper end 60 peaks along a forward portion and dips along a rearward portion so that the opening 62 is asymmetric and defines a preferential direction for pouring. The spout fitment further includes an outer sidewall 64 or skirt portion depending from an annular web 66 forming a junction with the inner sidewall 52.

Figure 6:
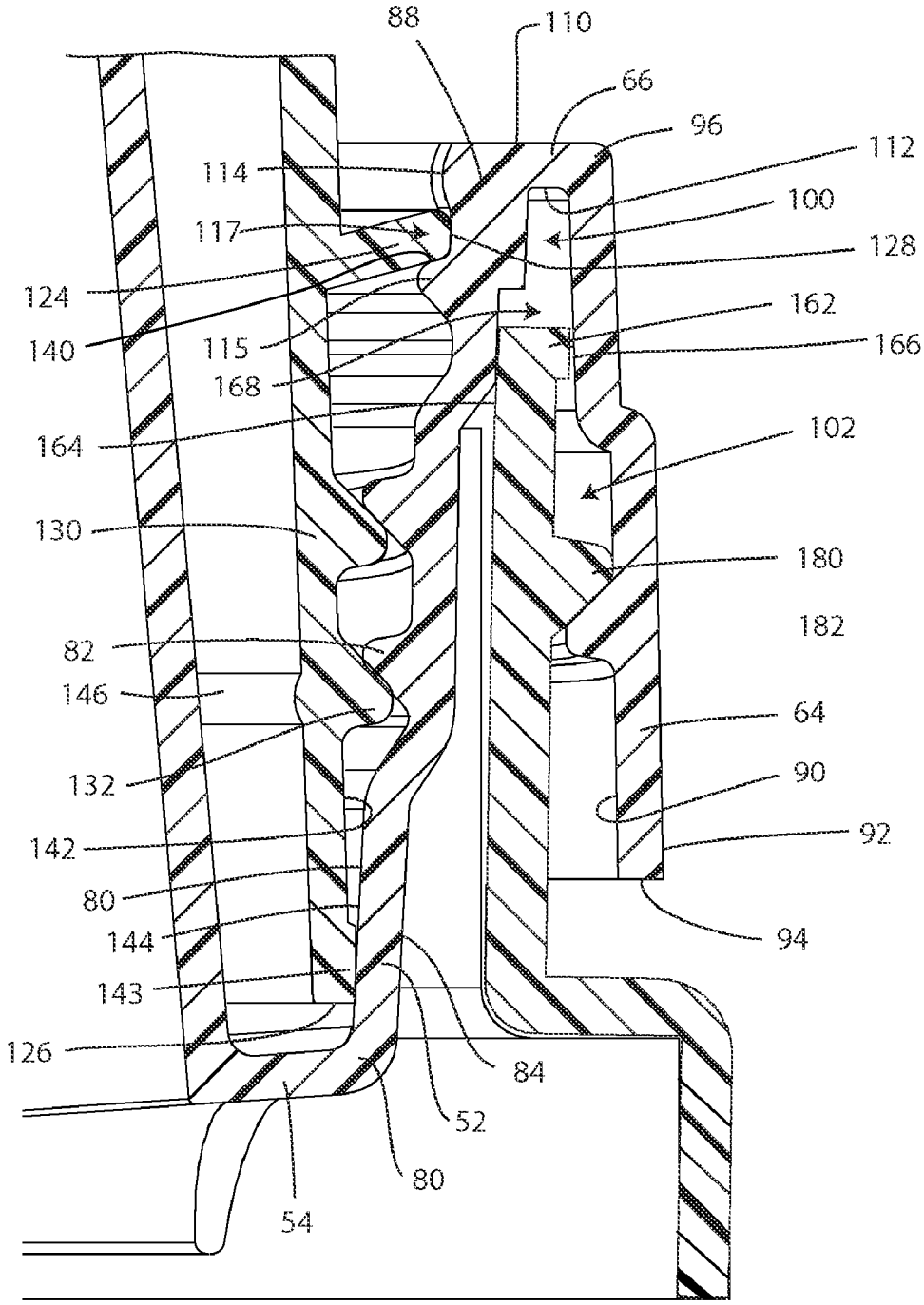
FIG. 6 is an enlarged view of a forward portion of the neck, spout fitment, and cap of FIG. 5.
Figure 7:
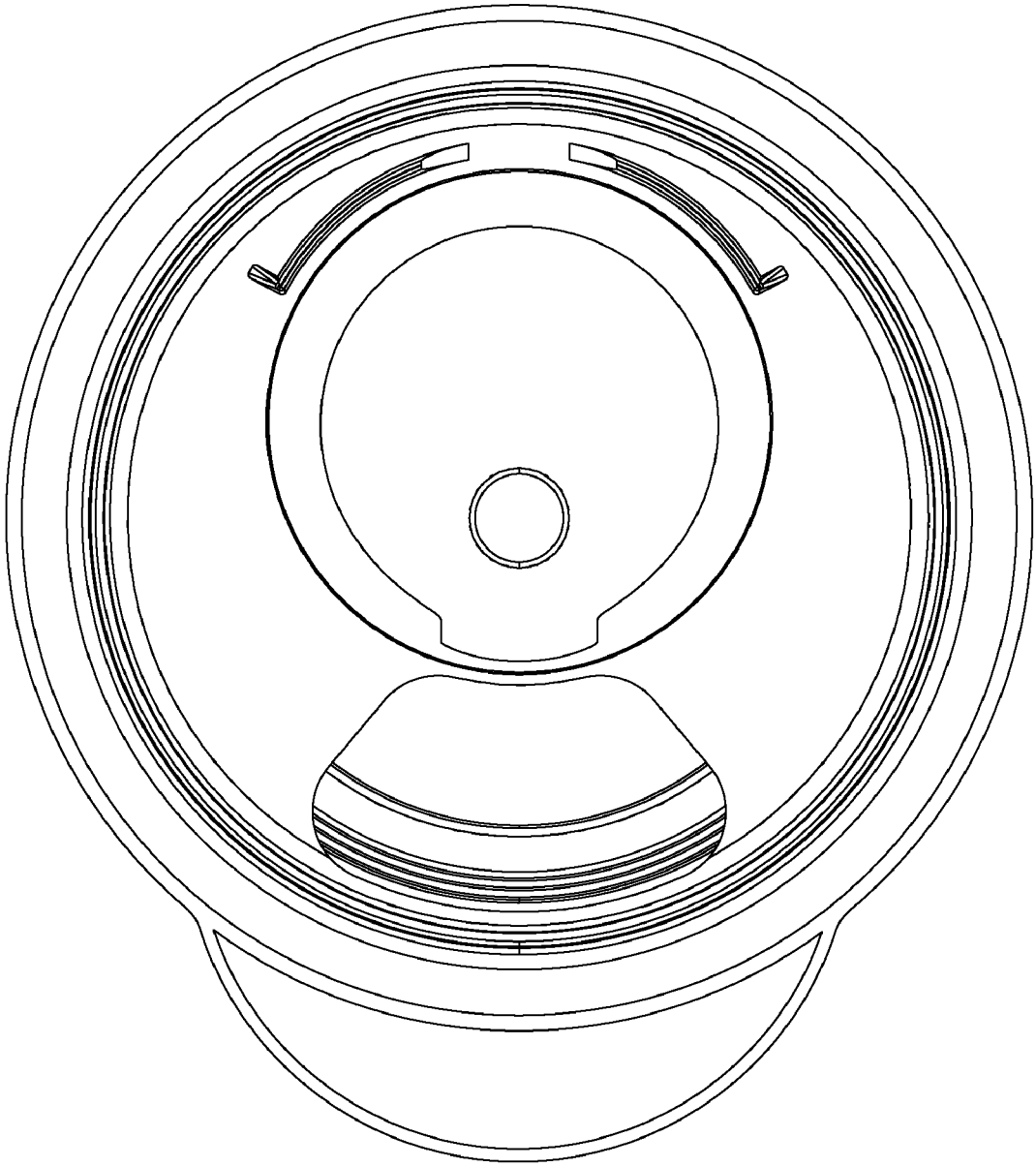
FIG. 7 is an upward sectional view of the bottle of FIG. 1.
Figure 8:
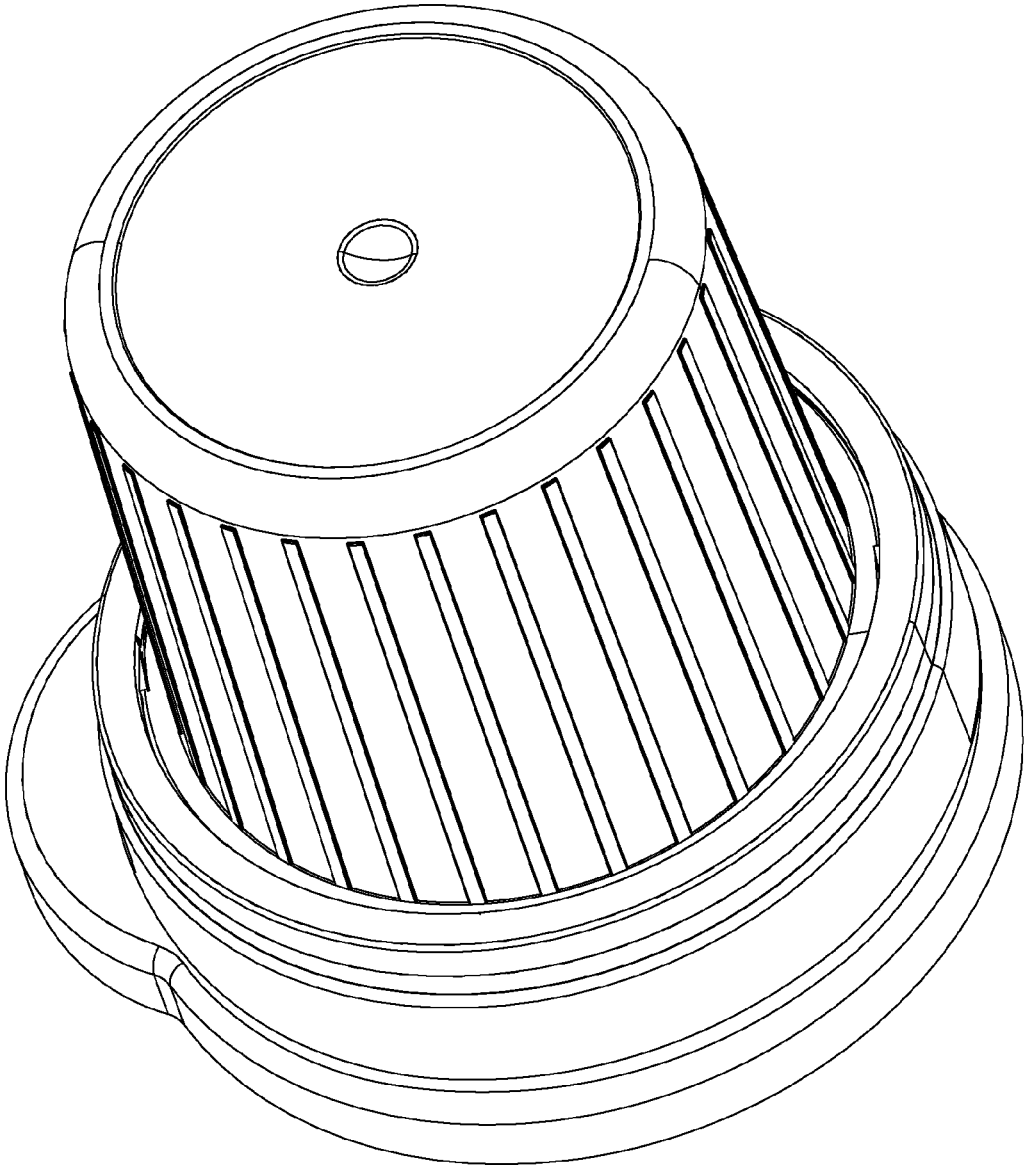
FIG. 8 is a cutaway view of the neck region, spout fitment, and cap of the bottle of FIG. 1.
Figure 9:
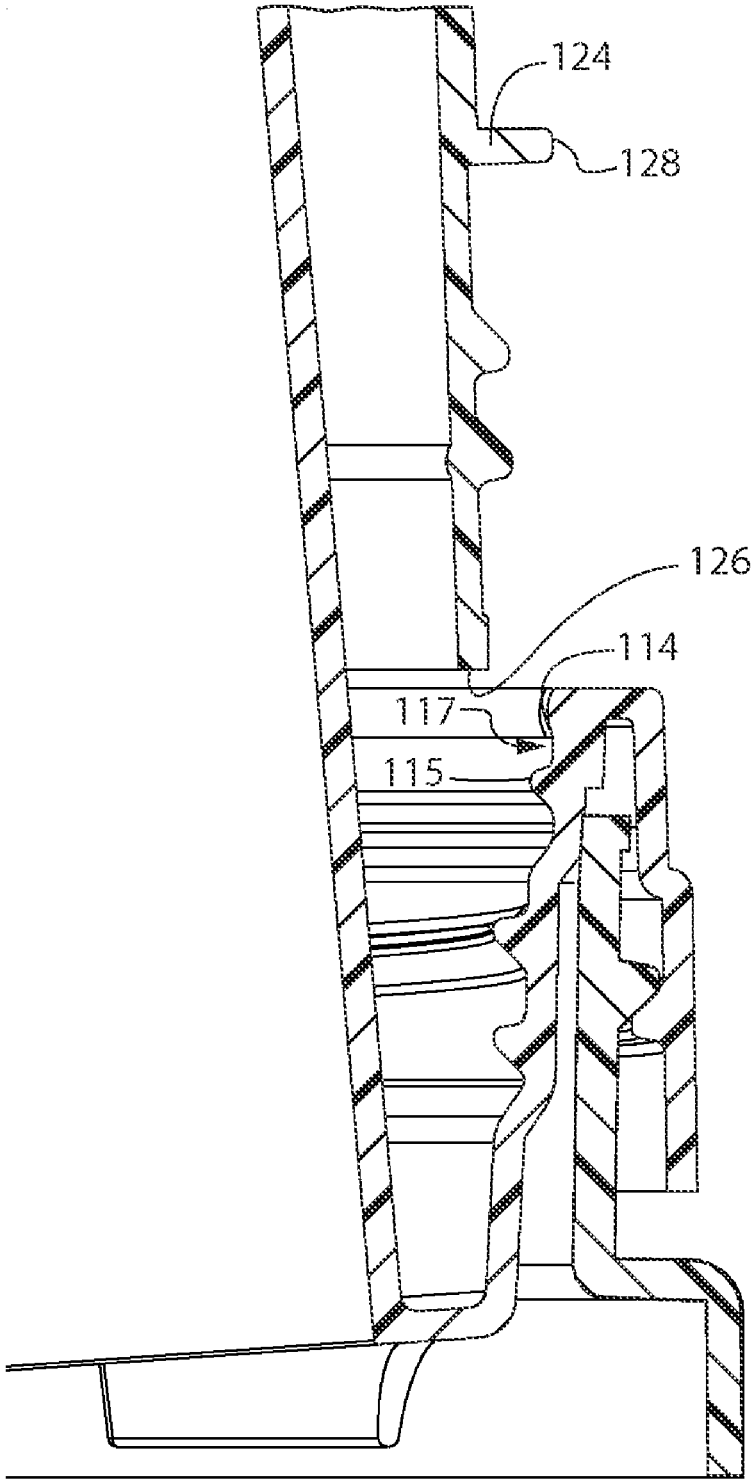
FIG. 9 is a view of the forward portion of the neck, spout fitment, and cap in a removed condition.

FIG. 6 shows the spout fitment inner sidewall 52 as having an inboard surface 80 bearing an internal thread 82. The sidewall 52 has an external/outboard surface 84. The sidewall 52 has a lower end at a junction 86 with the lower wall 54 and an upper end at a junction 88 with the web 66. The outer sidewall 64 has an inboard surface 90 and an outboard surface 92. The sidewall 64 extends from a lower end/rim 94 to an upper end at a junction 96 with the web 66. Upper portions of the sidewalls 52 and 64 converge slightly toward each other to cooperate with the web 66 to define, therebetween, a narrowed base/proximal portion 100 of an annular channel 102.

The web 66 has an upper surface 110 defining a rim of the spout fitment. The web 66 has a lower surface/underside 112 defining a base (base surface) of the channel 102 and of its base/proximal portion 100. As is discussed further below, the spout fitment includes a pair of protrusions (protruding radially inward) for engaging the cap 26. An upper protrusion 114 is formed as an annular bead. A lower protrusion 115 therebelow is similarly annular and extends slightly farther inward to cooperate with the bead 114 to define an inwardly-open channel 117.

The cap 26 (FIG. 5) includes a sidewall 120, a transverse web 122 at the upper end of the sidewall, and an outwardly projecting flange 124 spaced above a lower end rim 126 of the sidewall. The flange has upper and lower faces joining at a periphery 128 (FIG. 6). A lower portion 130 (FIG. 6) of the cap sidewall 120 depends below the flange 124 and bears an external thread 132 for engaging the internal thread 82. In the installation of the cap 26 to the spout fitment 24, an initial threading stage brings the flange 124 into engagement with an upper portion of the bead 114. Further relative rotation drives the cap further downward, flexing one or both of the flange 124 and spout fitment. Yet further rotation brings the flange below the bead into the channel 117 and at least partially relaxes the flexing. The flange-to-bead interaction may produce a toggle or detent action. At least after a final stage of threading, the flange 124 remains flexed and seals against the spout. In the FIG. 6 example, the periphery 128 and an outboard portion of the flange underside seal along an internal shoulder 140 joining the projection 115 to the upper portion of the sidewall 52.

In the exemplary embodiment, at least the final stage of threading brings the outer surface 142 (e.g., along a sealing lip 143) of the sidewall lower portion 130 into sealing engagement with an adjacent tapering portion 144 of the inner sidewall inboard surface 80. If the portion 144 has a very gradual taper, one configuration of spout fitment may accommodate a number of different cap configurations. For example, the cap configurations may differ in the length of the sidewall portion 130 extending below the flange and threads. This may allow a single basic spout fitment to be used with a variety of caps of different capacity. Caps of different capacity may be used for different products and may include level markers 146. Varying the length below the flange and threads reduces or eliminates the need to vary the height above the flange. Thus, one can avoid an awkward looking high capacity cap having an excessively tall portion above the flange. Different capacity caps may be molded using the same basic die but with different pulls forming the sealing portion.

The double seal provided by: (1) the flange above; and (2) the threads and the cap sidewall below the threads serves to isolate the threads and keep them clean. It further reduces the chances for detergent etc. trapped on the threads to then drip of on the user or environment when the cap is removed.

With the spout fitment in the installed condition, the channel portion 100 captures an upper end portion 162 of the neck 36. In the channel portion 100, the surface 84 may seal against an inboard surface 164 of the neck and the surface 90 may seal against an outboard surface 166 of the neck. There may be a slight gap 168 above the neck ring.

Figure 3:
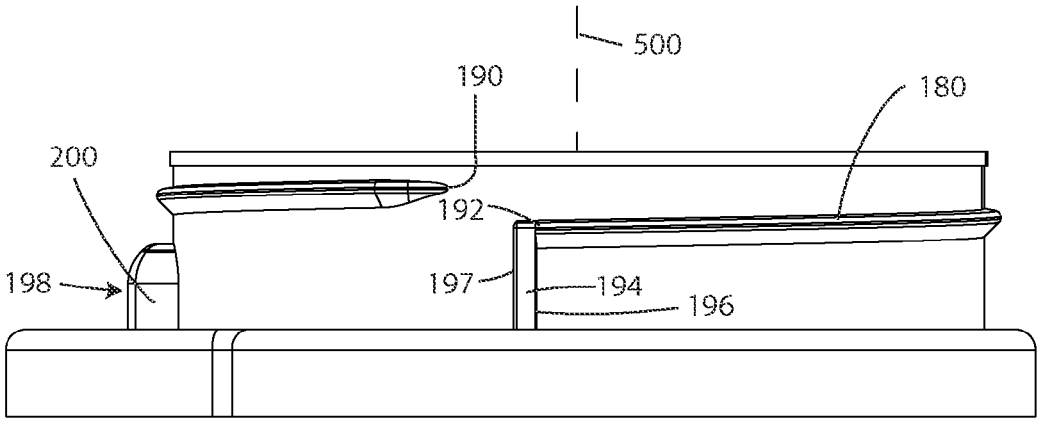
FIG. 3 is a side view of the neck region of FIG. 2.

FIG. 6 shows an external thread 180 on the body neck outboard surface 166. With the spout fitment installed, the thread 180 is engaged to an internal thread 182 protruding from the outboard sidewall inboard surface 90. As is discussed below, these threads and associated stop and lock features create a stripped thread non-unscrewing style connection between the spout fitment and body. FIG. 3 shows the bottle thread 180 as extending slightly less than one revolution from a leading end 190 to a trailing end 192. A stop 194 may be formed as a protrusion. The exemplary stop 194 is positioned approximately as a vertical extension of the thread. The stop 194 has a first surface 196 facing in the direction of the thread and an opposite second surface 197.

A body lock 198 is also formed at the base of the neck and has a tapered camming surface 200 on the same side as the surface 196. The lock 198 has a locking surface 202 (FIG. 2) opposite the surface 200.

Figure 4:
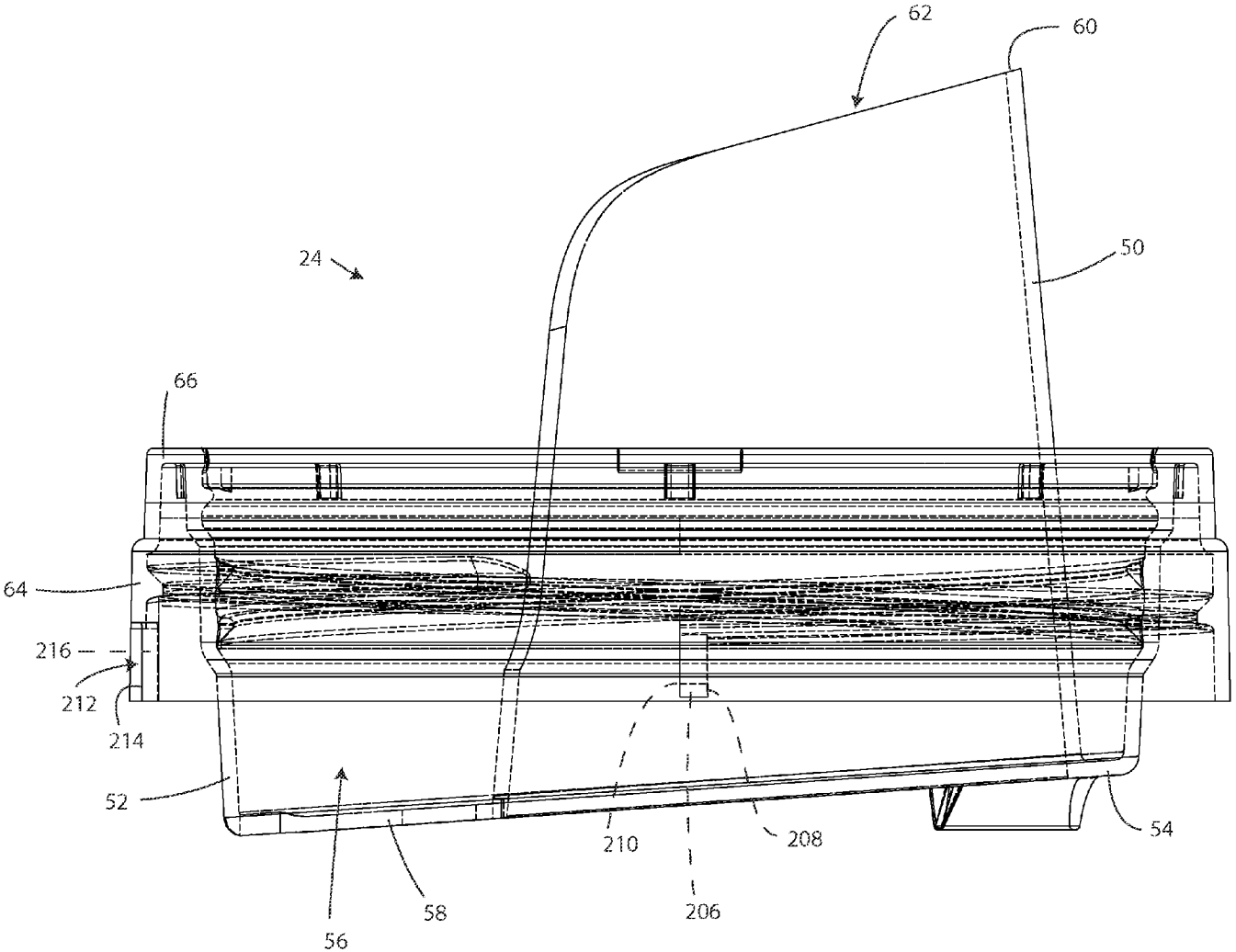
FIG. 4 is a side view of a spout fitment of the bottle of FIG. 1.

FIG. 4 shows the spout fitment as having a stop 206 similarly formed as a vertical extension of its associated thread 182. The stop has first and second surfaces 208 and 210. The fitment also has a recess 212 extending upward from the rim 94 having first and second end surfaces 214 and 216. The spout fitment may be mounted to the body by an insertion and rotation process. The initial insertion may cause the stop 206 to pass alongside the side/surface 198 of the stop 194. Threading rotation of the spout fitment relative to the body may drive the spout fitment slightly lower. During the rotation, the lock 198 may outwardly flex a lower portion of the spout fitment outer sidewall. After slightly less than one revolution, the side 210 of the stop 206 will approach the side 196 of the stop 194. As this happens, the lock 198 will become captured in the recess 212. Interaction of the leading side/surface 210 of the stop 206 with the surface 196 of the stop 194 will prevent further rotation in this direction. Interaction of the surface 202 with the adjacent end surface 216 of the recess 212 will prevent unthreading. Interaction of the threads 180 and 182 will prevent extraction.

In an exemplary method of assembly, the cap is fully or partially screwed onto the spout fitment. The spout fitment is then inserted into the bottle neck and threaded into the locked condition. If the bottle was not filled prior to insertion, the cap may be unscrewed and removed so that the bottle may then be filled. The cap may be further tightened (screwed back on).

The body, spout fitment, and cap may be separately molded. The body may be labeled and filled with the liquid before attaching the spout fitment to the body. The spout fitments and caps may be pre-assembled to each other and delivered to the bottler as units and installed in units, thereby easing installation.

One or more embodiments of the present invention have been described. Nevertheless, it will be understood that various modifications may be made without departing from the spirit and scope of the invention. For example, when implemented in the reengineering of an existing container configuration, details of the existing configuration may influence or dictate details of any particular implementation. Accordingly, other embodiments are within the scope of the following claims.

What is claimed is:

1. A container (20) comprising:
a body (22) having a body opening (40);
a spout fitment (24) within the body opening;
a cap (26) having:
a sidewall (120);
a web (122) enclosing an upper end of the sidewall;
a flange (124) extending outward from the sidewall;
an external thread (132) along the sidewall below the flange;
a removed condition disengaged from the body and spout fitment; and
an installed condition threadingly mounted by the external threads to at least one of the body and spout fitment,
wherein:
in the installed condition, a perimeter portion (128) of the flange is below a rim (110) of the spout fitment.

2. The container of claim 1 wherein:
in the installed condition, an upper surface of the flange is below the rim.

3. The container of claim 1 wherein:
in the installed condition, the perimeter portion is contacts the fitment to flex at least one of the fitment and flange.

4. The container of claim 1 wherein:
the spout fitment has an internal bead (114) cooperating with the flange to form a detent mechanism.

5. The container of claim 1 wherein:
the sidewall has an outboard surface portion below the external threads; and in the installed condition, the outboard surface portion is sealingly engaged to the spout fitment.

6. The container of claim 5 wherein:

in the installed condition, the outboard surface portion and the flange cooperate with the spout fitment to isolate the threads.

7. The container of claim 1 wherein:

the spout fitment defines a drain-back trough having a drain-back port.

8. The container of claim 1 wherein:

the body opening is in a neck of the body;

the spout fitment has first and second walls respectively inboard and outboard of the neck; and the second wall has a recess in locking engagement with a projection of the neck.

9. The container of claim 1 wherein:

the spout fitment is neither welded, nor adhesively secured to the body.

10. The container of claim 1 further comprising:

means on the body and spout fitment for preventing relative rotation of the body and fitment about a central longitudinal axis of the opening.

11. The container of claim 1 wherein:

the body consists essentially of HDPE;

the spout fitment consists essentially of polypropylene; and the cap consists essentially of polypropylene.

12. The container of claim 1 wherein:

the body has an integrally molded handle; and an interior compartment of the body extends through the handle.

13. The container of claim 1 further comprising:

1.0-6.0 liters of a liquid within the body.

14. The container of claim 1 further comprising:

at least 1.0 liter of liquid detergent or fabric softener within the body.

* * * * *